US006836063B2

(12) United States Patent
Ishimoto et al.

(10) Patent No.: US 6,836,063 B2
(45) Date of Patent: Dec. 28, 2004

(54) DISPLAY TUBE AND DISPLAY DEVICE

(75) Inventors: Manabu Ishimoto, Kawasaki (JP); Tsutae Shinoda, Kawasaki (JP); Akira Tokai, Kawasaki (JP); Hitoshi Yamada, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 10/094,794

(22) Filed: Mar. 12, 2002

(65) Prior Publication Data

US 2003/0025440 A1 Feb. 6, 2003

(30) Foreign Application Priority Data

Jul. 31, 2001 (JP) ..... 2001-232247

(51) Int. Cl.[7] ..... H01J 1/62

(52) U.S. Cl. ..... 313/484; 313/607; 313/623; 313/485; 313/326; 313/291; 313/594

(58) Field of Search ..... 313/484, 607, 313/623, 485, 326, 291, 594; 315/325, 291

(56) References Cited

U.S. PATENT DOCUMENTS

| | | | | | |
|---|---|---|---|---|---|
| 4,871,941 | A | * | 10/1989 | Dobashi et al. | 313/485 |
| 4,987,341 | A | * | 1/1991 | Achter et al. | 313/623 |
| 5,013,966 | A | * | 5/1991 | Saikatsu et al. | 313/493 |
| 5,049,777 | A | * | 9/1991 | Mechtersheimer | 313/35 |
| 5,117,160 | A | * | 5/1992 | Konda et al. | 315/326 |
| 5,444,335 | A | * | 8/1995 | Matsumoto et al. | 315/246 |
| 5,514,934 | A | * | 5/1996 | Matsumoto et al. | 313/607 |
| 6,331,064 | B1 | * | 12/2001 | Nishiyama et al. | 362/260 |

FOREIGN PATENT DOCUMENTS

JP 2000-315460 11/2000

* cited by examiner

*Primary Examiner*—Ashok Patel
*Assistant Examiner*—Holly Harper
(74) *Attorney, Agent, or Firm*—Staas & Halsey

(57) ABSTRACT

A display tube is provided that can improve light emission efficiency without raising a breakdown voltage. The display tube has a tubular vessel defining a discharge gas space and a pair of display electrodes for generating surface discharge along the circumferential surface of the vessel and opposing discharge traversing the inside of the vessel.

7 Claims, 5 Drawing Sheets

DISPLAY TUBE AND DISPLAY DEVICE

BACKGROUND OF THE INVENTION

1. Field of the Invention

The present invention relates to a display tube that can emit light partially and a display device constituted by combining a plurality of display tubes.

There is a limit on increasing a screen size of a single display. Therefore, a large display of an array format in which multiple display tubes are arranged has been developed toward commercialization.

2. Description of the Prior Art

A large display utilizing the light emission principle of a surface discharge type plasma display panel (PDP) is disclosed in Japanese unexamined patent publication No. 2000-315460. The display device shown in FIGS. 15 and 17 in the document includes multiple display tubes arranged in parallel and a substrate for supporting the display tubes. Each of the display tubes includes strap-like display electrodes arranged on the outer surface of a glass tube containing a discharge gas in the length direction, and elongated address electrodes (data electrodes) arranged in the glass tube so as to cross all the display electrodes. Two display electrodes neighboring at a predetermined gap constitute an electrode pair for surface discharge. On the substrate, band-like bus electrodes (power supplying conductors) are arranged so as to cross the data electrodes, and the display tubes are disposed on the substrate so that the display electrodes contact the bus electrodes. The bus electrode makes electric connection of the display electrodes at the same position in the length direction of all the display tubes. In other words, the bus electrodes and the data electrodes form an electrode matrix. In the same manner as a single PDP, a potential control of the electrode matrix is performed for displaying a desired image.

Since the display electrodes are formed in each of the display tubes, it is easy to determine the area (i.e., the position of cells) that generates surface discharge, compared with a structure in which a bus electrode for plural display tubes is used as the display electrode.

As explained above, the form of arranging strap-like display electrodes for generating surface discharge along the length direction is suitable for reducing a diameter (a width) of display tubes, compared with a form of arranging a pair of elongated display electrodes along the length direction for generating surface discharge along the width direction. It may impair the productivity to classify colors of fluorescent materials in a display tube for a color display. Therefore, if one display tube has one light emission color, three display tubes consist a pixel. It is desirable for a high definition color display to thin the display tube for reducing a cell pitch in the tube arrangement direction.

In the conventional device, display electrodes making a pair are arranged closely to each other for forming a small surface discharge gap, so that a driving voltage can be lower than in the case of opposing discharge that traverse a tubular discharge space in the radial direction.

The conventional display device has a problem that though discharge can be generated at lower voltage than in the opposing discharge type by reducing the gap between the display electrodes, it is difficult to improve light emission efficiency.

SUMMARY OF THE INVENTION

An object of the present invention is to improve light emission efficiency without raising a breakdown voltage.

According to the present invention, a display tube having a tubular vessel defining a discharge gas space is used for a display, and a pair of display electrodes generates surface discharge along the circumferential surface of the vessel and opposing discharge traversing the inside of the vessel. A breakdown voltage can be lowered by shortening a surface discharge gap, and a positive column having high excitation efficiency can be extended by generating opposing discharge at a portion where the electrodes are opposed to each other at a distance similar to a diameter of the vessel. The display tube has a display electrode pair having portions being close to each other along the circumferential surface of the vessel and portions opposed to each other with respect to the discharge gas space, so that the surface discharge transfers to the opposing discharge.

DESCRIPTION OF THE PREFERRED EMBODIMENTS

Hereinafter, the present invention will be explained more in detail with reference to embodiments and drawings.

Figure 1:
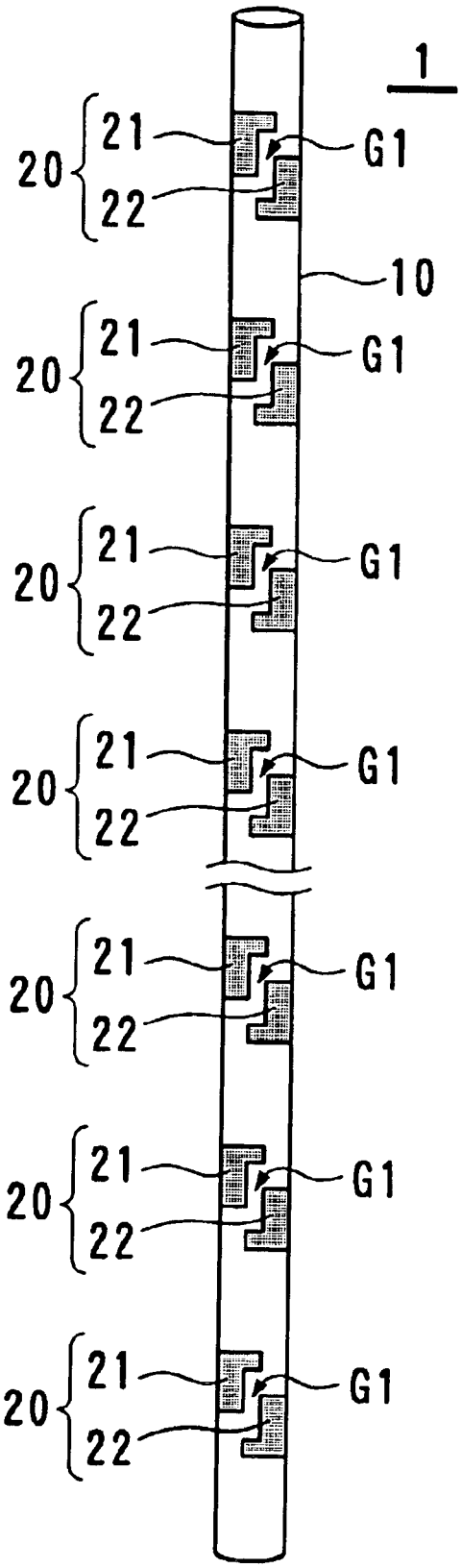
FIG. 1 is a diagrammatic sketch of a combination discharge type display tube according to the present invention.

FIG. 1 is a diagrammatic sketch of a combination discharge type display tube according to the present invention.

The display tube 1 includes a tubular vessel 10 for defining a discharge gas space and emits light by gas discharge. Plural display electrode pairs 20 are arranged at a space on the outer surface of the vessel 10 in the length direction of the vessel 10. The display electrode pair 20 includes display electrodes 21 and 22 neighboring to each other at a surface discharge gap G1 in the circumferential direction of the vessel 10 and defines a cell. In FIG. 1 the arrangement space of the display electrode pair 20 is shown large, but it can be smaller as long as it is not smaller than the surface discharge gap G1, so that a cell pitch is reduced.

Figure 2:
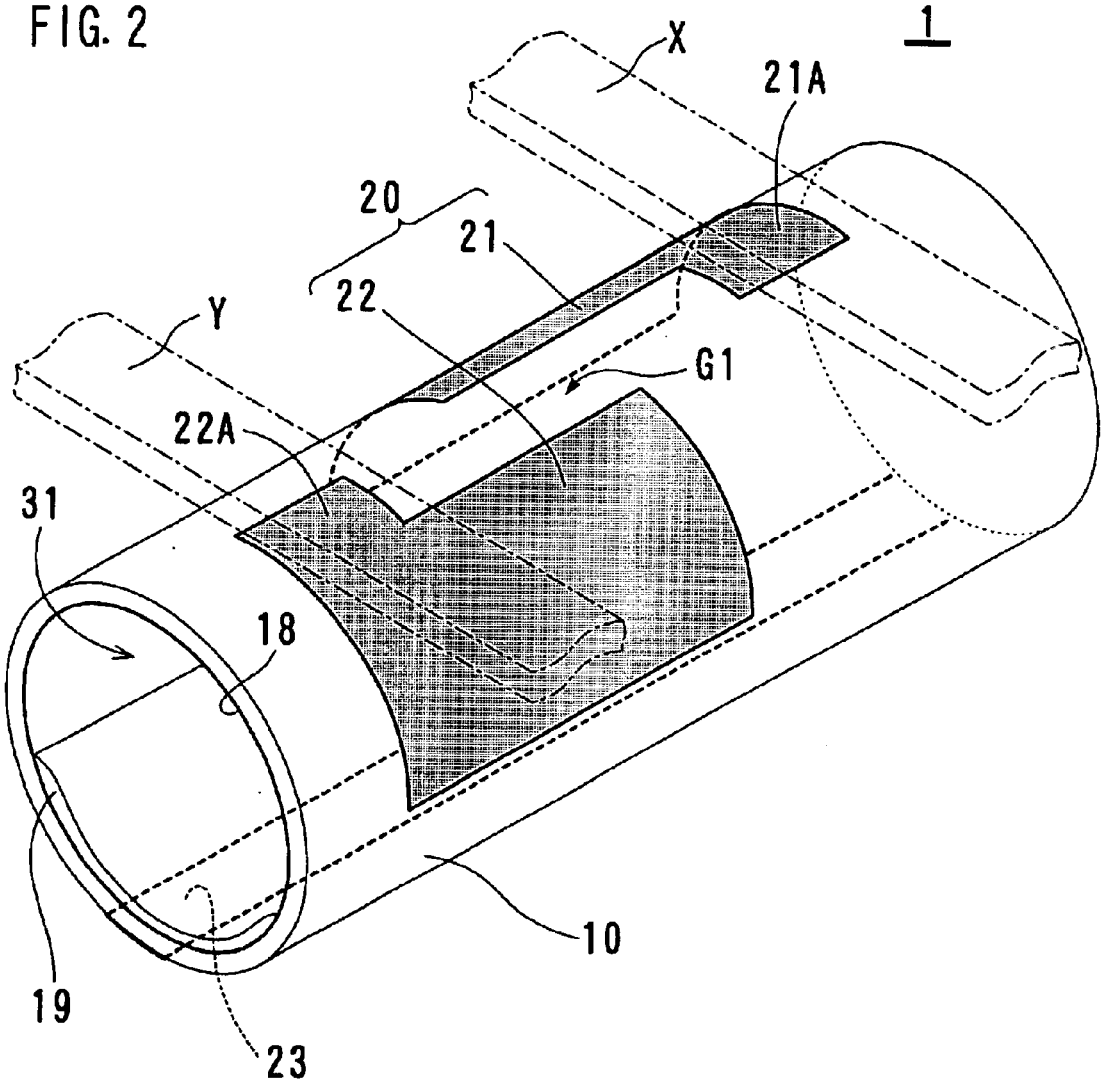
FIG. 2 is a perspective view showing a structure of a principal part of the display tube.

FIG. 2 is a perspective view showing a structure of a principal part of the display tube.

The vessel 10 is a cylindrical glass tube, and the display electrodes 21 and 22 are made of a transparent conductive film coated on the outer surface of the vessel 10. The surface discharge gap G1 is disposed at the front portion of the display tube 1, and the display electrodes 21 and 22 are separated from each other extending from the surface discharge gap G1 to the boundaries of the front portion and the rear portion of the vessel 10 along the outer circumferential surface of the vessel 10. The display electrodes 21 and 22 are supplied with power via bus electrodes X and Y arranged separately in the length direction of the vessel 10 with respect to the surface discharge gap G1. The display electrodes 21 and 22 have contact portions 21A and 22A contacting the bus electrodes X and Y arranged on the front side of the display tube 1.

On the outer back surface of the vessel 10, a band-like conductive film is formed as a data electrode 23 for generating display-selecting discharge (address discharge) between the display electrode 22 and the data electrode 23. The inner surface of the vessel 10 is coated with a magnesia film 18 for protecting the glass tube as a dielectric and for reducing a discharge start voltage. In addition, a fluorescent material layer 19 is arranged on the back portion of the inner surface of the vessel 10 so as to prevent contact with the portion of the display electrodes 21 and 22. The fluorescent material layer 19 can be formed by coating fluorescent material paste on the inner surface of the glass tube or can be arranged in the glass tube by forming a fluorescent material layer on the base member that is a plate curved along the inner surface of the glass tube and by inserting the base member into the glass tube.

Figure 3:
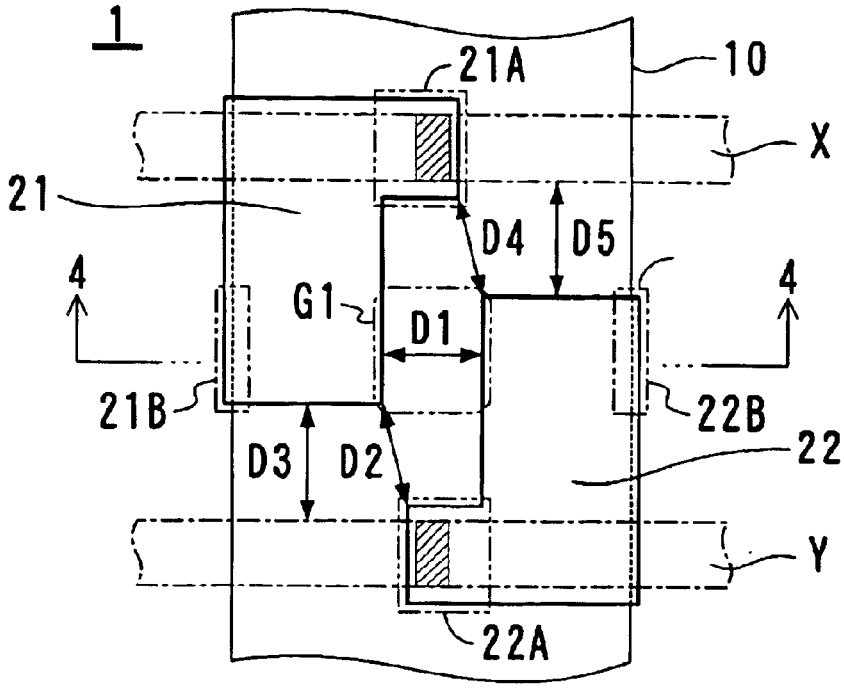
FIG. 3 is a diagram showing an electrode gap of the display tube.

FIG. 3 is a diagram showing an electrode gap of the display tube.

As explained above, though the display electrodes 21 and 22 are curved so that portions 21B and 22B of them are opposed, the shape of the display electrodes 21 and 22 is substantially L-form in a plan view as shown in FIG. 3. The shortest distance between the display electrodes 21 and 22 making a pair is a discharge gap length D1 that is a distance between the portions that form the surface discharge gap G1. The distance D2 between the display electrode 21 and the contact portion 22A of the display electrode 22, the distance D3 between the display electrode 21 and the bus electrode Y, the distance D4 between the display electrode 22 and the contact portion 21A of the display electrode 21, and the distance D5 between the display electrode 22 and the bus electrode X are all longer than the discharge gap length D1.

Figure 4:
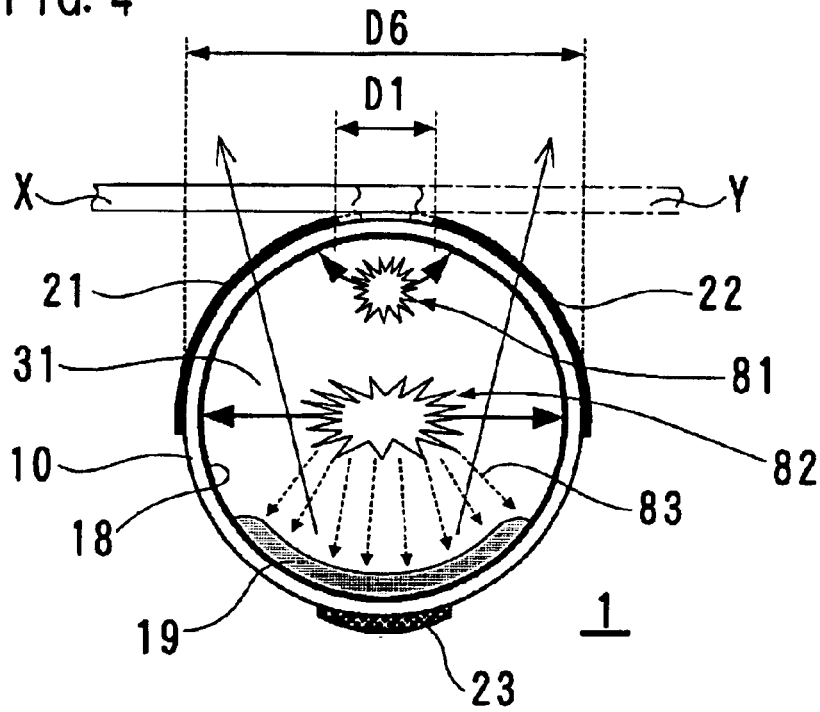
FIG. 4 is a cross section view showing an inner structure of the display tube.

FIG. 4 is a diagram showing an inner structure of the display tube, i.e., a cross section taken along the line 4—4 in FIG. 3.

When a predetermined voltage is applied to the display electrodes 21 and 22, surface discharge 81 is generated in the front portion of the discharge gas space 31 (the upper portion in FIG. 4). The surface discharge 81 spreads along the inner surface of the vessel 10 and causes opposing discharge 82. This sequential set of discharge is called "combination discharge". The electrode gap D6 for the opposing discharge is the outer diameter of the vessel 10 and is more than twice as long as the discharge gap length D1. For this reason, in the combination discharge, excitation efficiency of the discharge gas is larger and ultraviolet rays 83 are generated more than in the surface discharge, so that the fluorescent material layer 19 can be lighted efficiently. In addition, since discharge is generated in the portion close to the fluorescent material, high light emission efficiency can be obtained.

Figure 5:
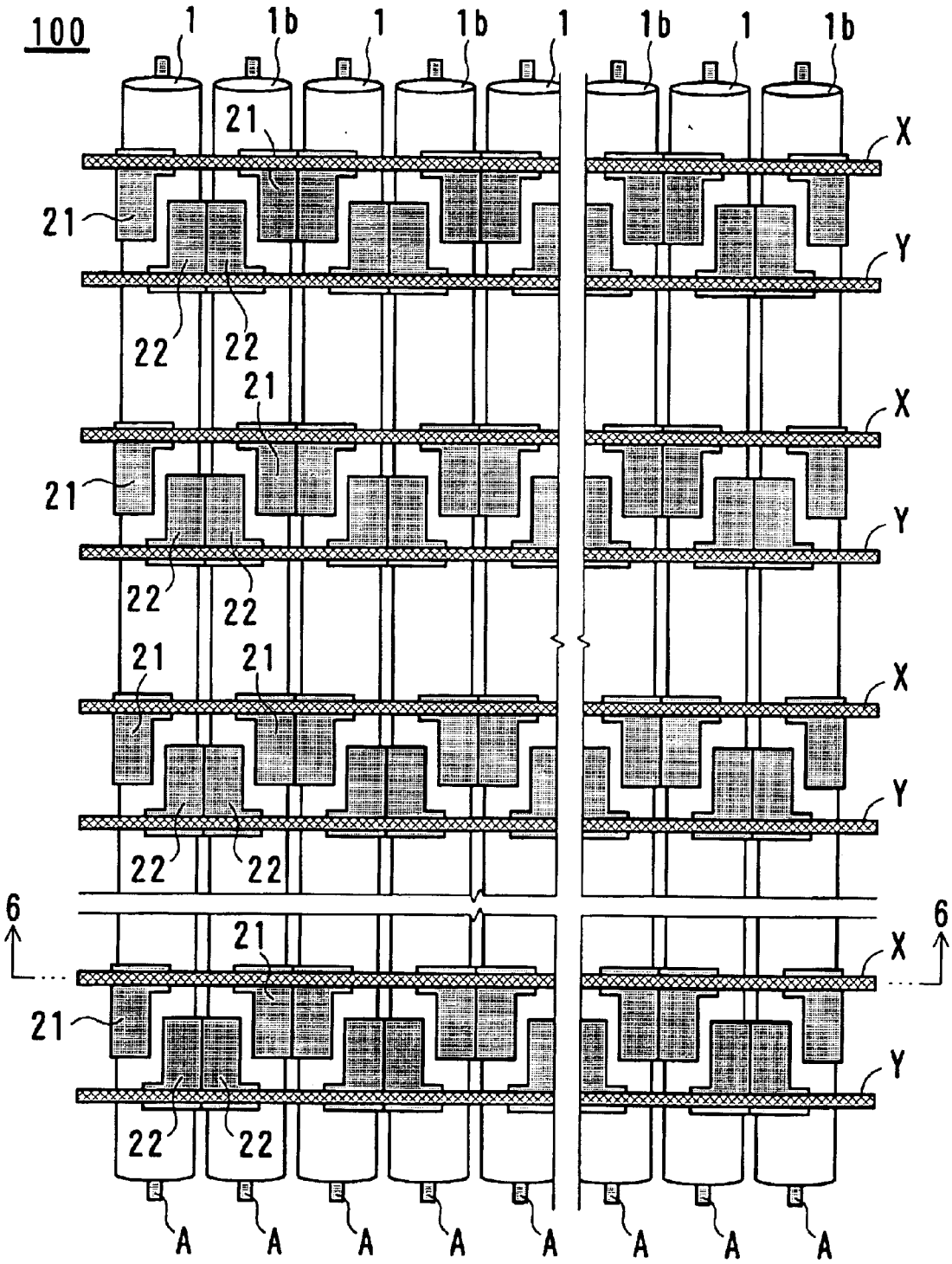
FIG. 5 shows a structure of a combination discharge type display device according to the present invention.

FIG. 5 shows a structure of a combination discharge type display device according to the present invention.

The display device 100 includes display tubes 1 and 1*b* arranged alternately one by one, bus electrodes X and Y and data electrode terminals A. The structure of the display tube 1*b* is the same as that of the above-mentioned display tube 1 except the arrangement of the display electrodes 21 and 22. In the display tube 1*b*, the display electrodes 21 and 22 are symmetric with respect to an imaginary line along the length direction of the vessel 10 when they are arranged next to the display tube 1. Therefore, in the display device 100, the neighboring display tubes have neighboring display electrodes at the same position in the length direction of the tube. The neighboring display electrodes are connected with each other via the bus electrode X or Y and are controlled in common. Thus, since discharge between the neighboring display tubes 1 and 1*b* is prevented in the display device 100, the display tubes can be arranged closely, and an insulator for preventing undesired discharge is not required.

The bus electrodes X and Y connect display electrodes at the same position in the length direction of the tube as shown in FIG. 5 and constitute the electrode matrix with the above-mentioned data electrodes 23 (see FIG. 2). The data electrode terminal A is provided for connecting the data electrode 23 to a driving circuit. The data electrode terminal A can be disposed so as to overlap only an edge portion of the data electrode 23 or overlap the entire length of the data electrode 23. If the data electrode terminal A is disposed over the entire length of the display tube 1 or 1*b*, the data electrode 23 can be omitted.

Figure 6:
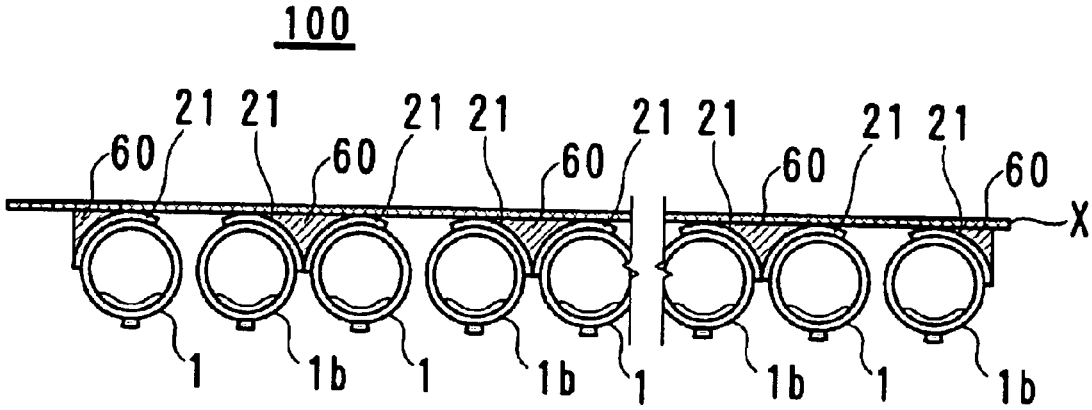
FIG. 6 is a cross section view showing a connection form of a display electrode with a bus electrode.
Figure 7:
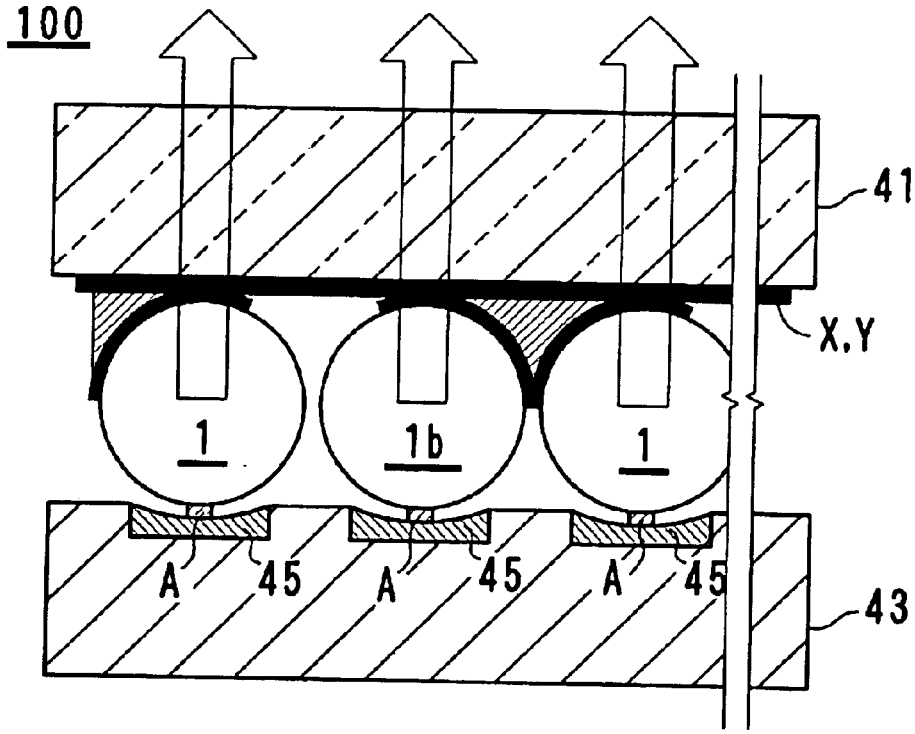
FIG. 7 is a schematic diagram of a structure for supporting the display tube.

FIG. 6 is a diagram showing a connection form of the display electrode with the bus electrode, i.e., a cross section taken along the line 6—6 in FIG. 5. FIG. 7 is a schematic diagram of a structure for supporting the display tube.

A conductive adhesive 60 is embedded in the gap between the bus electrode X or Y (only the electrode X is illustrated in FIG. 6) and the display electrode 21. As a result, connection area increases and reliability of power supply is enhanced compared to the case where the bus electrode X contacts the contact portion 21A. In the same way, the conductive adhesive 60 is embedded also in the gap between the bus electrode Y and the display electrode 22 of the display device 100. As shown in FIG. 7, the bus electrodes X and Y are arranged on a front transparent substrate 41. In the display device 100, an elastic insulator layer 45 is disposed on a back substrate 43, and the data electrode terminal A is disposed on the elastic insulator layer 45. Accuracy of the tube diameter is approximately ±2% of the diameter, so there is a possibility of 4% difference between the neighboring display tubes. When the display tubes 1 and 1*b* are sandwiched between flat substrates, the electric connection between the substrate and the display tubes 1 and 1*b* can be insufficient. By using the elastic insulator layer 45 between the substrate and the display tubes 1 and 1*b*, the electric connection can be sufficient. In other words, tolerance of variation of the tube diameter is enlarged.

In the above-mentioned embodiment, the shape of the display electrodes 21 and 22 for generating the combination discharge is not limited to the illustrated example. For example, if the conductive adhesive is used for connecting the bus electrodes X and Y as shown in FIG. 6, the contact portions 21A and 22A can be omitted. It is possible to dispose the display electrodes 21 and 22 on the back side of the display tube 1. If the display electrodes 21 and 22 are disposed on the back side, the display electrode can be non-transparent.

While the presently preferred embodiments of the present invention have been shown and described, it will be understood that the present invention is not limited thereto, and that various changes and modifications may be made by those skilled in the art without departing from the scope of the invention as set forth in the appended claims.

What is claimed is:

1. A display tube comprising a tubular vessel defining a discharge gas space to emit light by gas discharge, wherein:

a plurality of display electrode pairs is spaced along a length direction of the vessel, each of the display electrodes is a transparent conductive film, coated on an outer surface of the vessel and having a contact portion externally connecting a discharge surface portion thereof to a corresponding bus electrode along a circumferential surface of the vessel, in each of the display electrode pairs, the display electrodes are adjacent to each other at a discharge gap, and a part of a first display electrode and a part of a second display electrode are opposed to each other at a distance longer than the discharge gap with respect to the discharge gas space, and the contact portions in all of the display electrodes are in a same plane in a circumferential direction of the vessel.

2. The display tube according to claim 1, further comprising a data electrode disposed along the length direction of the vessel and opposed to the plural electrode pairs and a fluorescent material arranged inside the vessel.

3. The display tube according to claim 1, wherein the shape of the display electrode is substantially an L-form in a plan view.

4. A display device comprising a group of display tubes arranged in parallel to emit light by gas discharge, wherein:

each of the display tubes includes a tubular vessel defining a discharge gas space and a plurality of display electrode pairs spaced along a length direction of the vessel, on the display tubes, the display electrodes located at a common position in the length direction of the vessel are connected electrically to respective bus electrodes, on each of the display tubes, each of the display electrodes is a transparent conductive film, coated on an outer surface of the vessel and having a contact portion externally connecting a discharge surface portion thereof to a corresponding bus electrode along a circumferential surface of the vessel, and the display electrodes of each of the display electrode pairs are adjacent to each other at a discharge gap and are opposed to each other at a distance longer than the discharge gap with respect to the discharge gas space, and contact portions in all of the display electrodes are in a same plane in a circumferential direction of the vessel.

5. The display tube according to claim 4, wherein the display electrodes at the same position in the length direction of the vessel are adjacent to each other between neighboring display tubes.

6. The display tube according to claim 4, wherein a conductive material is embedded in a gap between the power supplying conductor and the display electrode.

7. The display tube according to claim 6, wherein the group of display tubes is supported between a back substrate and a transparent front substrate, and an elastic insulator is disposed between the display tube and the back substrate.

* * * * *